US010587037B2

(12) United States Patent
Chiu et al.

(10) Patent No.: US 10,587,037 B2
(45) Date of Patent: Mar. 10, 2020

(54) ELECTRONIC PACKAGE STRUCTURE

(71) Applicant: Siliconware Precision Industries Co., Ltd, Taichung (TW)

(72) Inventors: Chih-Hsien Chiu, Taichung (TW); Heng-Cheng Chu, Taichung (TW); Chien-Cheng Lin, Taichung (TW); Tsung-Hsien Tsai, Taichung (TW); Chao-Ya Yang, Taichung (TW); Yude Chu, Taichung (TW)

(73) Assignee: Siliconware Precision Industries Co., Ltd., Taichung (TW)

( * ) Notice: Subject to any disclaimer, the term of this patent is extended or adjusted under 35 U.S.C. 154(b) by 851 days.

(21) Appl. No.: 14/107,446

(22) Filed: Dec. 16, 2013

(65) Prior Publication Data

US 2014/0210672 A1 Jul. 31, 2014

(30) Foreign Application Priority Data

Jan. 25, 2013 (TW) ..... 102102797 A

(51) Int. Cl.

| | |
|---|---|
| ***H01Q 1/38*** | (2006.01) |
| ***H01Q 1/22*** | (2006.01) |
| ***H01Q 9/04*** | (2006.01) |
| *H01Q 1/24* | (2006.01) |

(52) U.S. Cl.

CPC ..... *H01Q 1/38* (2013.01); *H01Q 9/0407* (2013.01); *H01Q 1/2283* (2013.01); *H01Q 1/243* (2013.01)

(58) Field of Classification Search

CPC ..... H01Q 1/38; H01Q 9/0407; H01Q 1/243; H01Q 9/0414; H01Q 1/2266; H01Q 1/2283

USPC ..... 343/700

See application file for complete search history.

(56) References Cited

U.S. PATENT DOCUMENTS

| | | | | |
|---|---|---|---|---|
| 6,404,395 | B1 * | 6/2002 | Masuda | H01Q 1/243 343/700 MS |
| 6,762,723 | B2 * | 7/2004 | Nallo | H01Q 1/243 343/700 MS |
| 6,958,732 | B2 * | 10/2005 | Yuanzhu | H01Q 1/243 343/702 |
| 7,312,528 | B2 * | 12/2007 | Watanabe | H01L 23/5227 257/528 |
| 7,482,204 | B2 * | 1/2009 | Kao | H01L 23/13 257/E23.101 |
| 7,545,329 | B2 * | 6/2009 | Gaucher | H01Q 9/26 343/700 MS |

(Continued)

*Primary Examiner* — Daniel Munoz
*Assistant Examiner* — Patrick R Holecek
(74) *Attorney, Agent, or Firm* — Mintz Levin Cohn Ferris Glovsky and Popeo, P.C.; Peter F. Corless; Steven M. Jensen

(57) ABSTRACT

An electronic package structure is provided, including a substrate, a package encapsulant disposed on the substrate, and an antenna structure corresponding to a disposing area of the package encapsulant and having a first extension layer, a second extension layer disposed on the substrate, and a connection portion disposed between and electrically connected to the first extension layer and the second extension layer. Through the formation of the antenna structure on the disposing area of the package encapsulant, the substrate is not required to be widen, and, as such, the electronic package structure meets the miniaturization requirement.

20 Claims, 8 Drawing Sheets

(56) References Cited

U.S. PATENT DOCUMENTS

| | | | | |
|---|---|---|---|---|
| 7,936,306 | B2 * | 5/2011 | Mierke | H01Q 21/28 343/700 MS |
| 7,944,038 | B2 * | 5/2011 | Chiu | H01L 23/3128 257/659 |
| 8,786,060 | B2 * | 7/2014 | Yen | H01L 23/552 257/660 |
| 8,957,826 | B2 * | 2/2015 | Kurashima | H01Q 1/38 343/702 |
| 2009/0267221 | A1 * | 10/2009 | Fujii | H01L 21/56 257/698 |
| 2010/0073255 | A1 * | 3/2010 | Noll | H01Q 1/40 343/873 |
| 2011/0180811 | A1 * | 7/2011 | Suzuki | G06K 19/07745 257/77 |

* cited by examiner

ELECTRONIC PACKAGE STRUCTURE

CROSS-REFERENCES TO RELATED APPLICATIONS

This application claims under 35 U.S.C. § 119(a) the benefit of Taiwanese Application No. 102102797, filed Jan. 25, 2013, the entire contents of which is incorporated herein by reference.

BACKGROUND OF THE INVENTION

1. Field of the Invention

This invention relates to electronic package structures, and, more particularly, to an electronic package structure having an antenna structure.

2. Description of Related Art

With the rapid development of electronic industry, electronic products are designed to have multiple functions and great performance. Wireless communication technology is widely applied to a variety of electronic products for the electronic products to receive and transmit wireless signals. A modern communication module is required to be compact-sized and low-profiled. A patch antenna, since being compact, light and easy to be manufactured, is widely applied to a wireless communication module of an electronic product, such as a cell phone, a personal digital assistant (PDA), etc.

FIG. 1 is a schematic diagram of a wireless communication module 1 according to the prior art. The wireless communication module 1 comprises a substrate 10, a plurality of electronic elements 13 disposed on the substrate 10, an antenna structure 12, and a package encapsulant 11. The substrate 10 is a rectangular circuit board. The electronic elements 13 are disposed on the substrate 10 and electrically connected to the substrate 10. The antenna structure 12 is planar and has an antenna body 120 and conductive wires 121. The antenna body 120 is electrically connected via the conductive wires 121 to the electronic elements 13. The package encapsulant 11 encapsulates the electronic elements 13 and a portion of the conductive wires 121.

In the wireless communication module 1, since the antenna structure 12 is planar, it is difficult to fabricate the antenna body 120 and the electronic elements 13 integrally due to the electromagnetic radiation characteristics between the antenna structure 12 and the electronic elements 13 and the volume limitation of the antenna structure 12. As a result, the package encapsulant 11 does not encapsulate the antenna body 120, but the electronic element 13 only. Accordingly, molds used in a packaging process have to correspond to a range of the electronic elements 13, rather than to the size of the substrate 10, which adversely affects the packaging process.

Moreover, since the antenna structure 12 is planar, an additional disposing region where the package encapsulant 11 is not formed needs to be further disposed on a surface of the substrate 10. Therefore, the width of the substrate 10 is difficult to be reduced, and so does the width of the wireless communication module 1. Accordingly, the wireless communication module 1 does not meet the compact-size and low-profile requirements.

Therefore, how to solve the problems of the prior art is becoming an urgent issue in the art.

SUMMARY OF THE INVENTION

In view of the above-mentioned problems of the prior art, the present invention provides an electronic package structure, comprising: a substrate; a package encapsulant disposed on the substrate; and an antenna structure corresponding to a disposing area of the package encapsulant and having a first extension layer, a second extension layer contacting the substrate, and a connection portion disposed between and electrically connected to the first extension layer and the second extension layer.

In an embodiment, the antenna structure further comprises an acting portion connected to the first extension layer or the second extension layer. For example, the acting portion has a ground region and a feeding region.

In an embodiment, the second extension layer is exposed from the substrate. For example, the extension portion is disposed on the package encapsulant, and extends and contacts the substrate.

In an embodiment, the second extension layer is disposed in the package encapsulant. For example, the connection portion is disposed on the package encapsulant.

In an embodiment, the second extension layer is embedded in the substrate. For example, the connection portion is disposed on the package encapsulant, or extends and contacts the substrate.

In an embodiment, the first extension layer is exposed from the package encapsulant.

In an embodiment, the first extension layer is disposed in the package encapsulant.

In an embodiment, the first extension layer and the second extension layer are disposed on two opposing sides of the substrate. For example, the connection portion is disposed on the substrate.

In an embodiment, the first extension layer is embedded in the substrate.

In an embodiment, the connection portion is disposed in the package encapsulant or disposed on a surface of the package encapsulant.

In an embodiment, the first extension layer is aligned or is not aligned with the second extension layer.

The present invention further provides an electronic package structure, comprising: a substrate; and an antenna structure having a first extension layer, a second extension layer contacting the substrate, and a connection portion disposed between and electrically connected to the first extension layer and the second extension layer such that the first extension layer is erected by the connection portion on the second extension layer.

In an embodiment, the antenna structure further comprises an acting portion connected to the first extension layer or the second extension layer. For example, the acting portion has a ground region and a feeding region.

In an embodiment, the second extension layer is exposed from the substrate or embedded in the substrate.

In an embodiment, the first extension layer is exposed from the substrate or embedded in the substrate.

In an embodiment, the first extension layer and the second extension layer are disposed on two opposing sides of the substrate.

In an embodiment, the connection portion is disposed in the substrate or disposed on a surface of the substrate.

In an embodiment, the first extension layer is aligned or is not aligned with the second extension layer.

It is thus known from the above that, in an electronic package structure according to the present invention, a first extension layer and a second extension layer are disposed on two opposing sides of a space, respectively, (e.g., one side of an package encapsulant and a surface of a substrate), and a connection portion is disposed on the package encapsulant and the substrate, such that a disposing area of an antenna structure corresponds to a range of the package encapsulant. Accordingly, molds in a packaging process correspond to the size of the substrate, which facilitates the packaging process.

Moreover, since the antenna structure corresponds to the range of the package encapsulant, no additional disposing region is required to be further formed on a surface of the substrate. Compared to the prior art, the substrate according to the present invention is narrower. As such, the width of the electronic package structure is reduced effectively, and the electronic package structure can thus meet the compact-size and low-profile requirements.

BRIEF DESCRIPTION OF DRAWINGS

The invention can be more fully understood by reading the following detailed description of the preferred embodiments, with reference made to the accompanying drawings, wherein.

DETAILED DESCRIPTION OF THE INVENTION

The following illustrative embodiments are provided to illustrate the disclosure of the present invention, these and other advantages and effects can be apparently understood by those in the art after reading the disclosure of this specification. The present invention can also be performed or applied by other different embodiments. The details of the specification may be on the basis of different points and applications, and numerous modifications and variations can be devised without departing from the spirit of the present invention.

FIGS. 2A, 2B, 2C and 2D are cross-sectional views of an electronic package structure 2 of a first embodiment according to the present invention.

Figure 1:
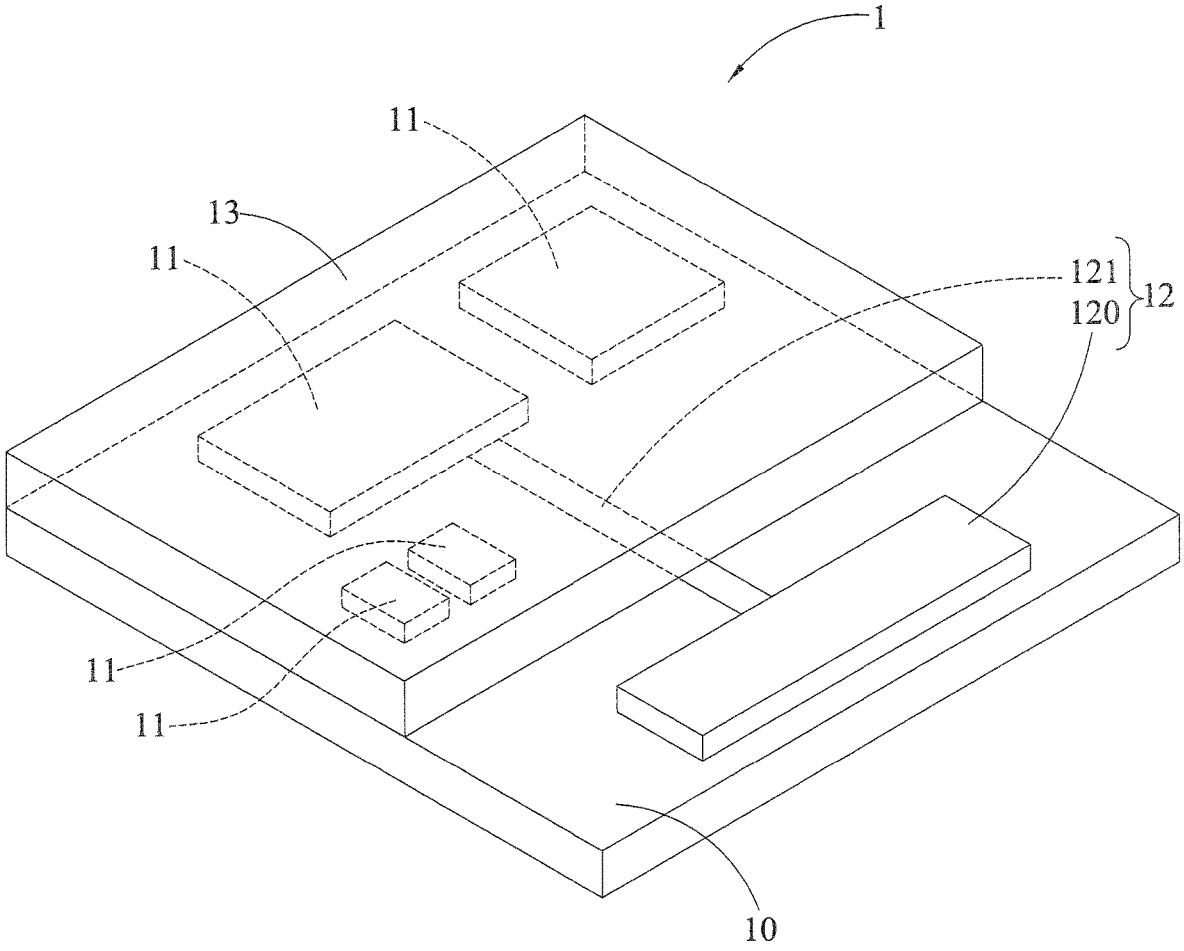
FIG. 1 (PRIOR ART)
FIG. 1 is a schematic diagram of a wireless communication module according to the prior art.
Figure 2A:
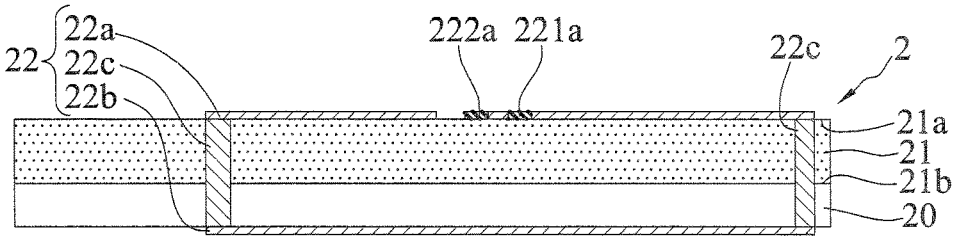
FIGS. 2A to 2D are cross-sectional views of an electronic package structure of a first embodiment according to the present invention, wherein FIG. 2A' is a top view of FIG. 2A.
Figure 2A:
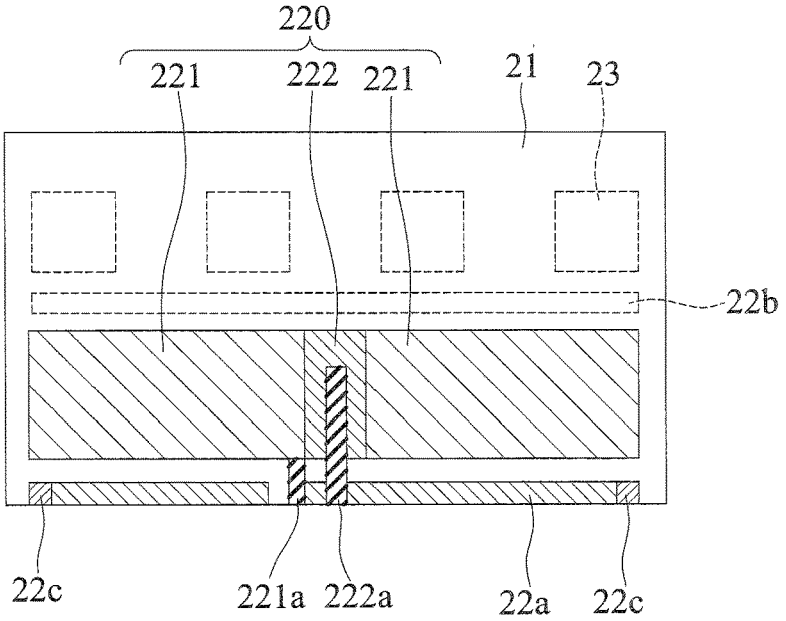

As shown in FIG. 2A, the electronic package structure 2 is a system in package (SiP) wireless communication module, and comprises a substrate 20, a package encapsulant 21 formed on the substrate 20, and an antenna structure 22.

The substrate 20 is a circuit board or a ceramic board, and has circuitry (not shown). The substrate 20 is not limited to the circuit board or the ceramic board, and can be any one of a variety of substrates. In an embodiment, a plurality of electronic elements 23, such as semiconductor elements, active elements or passive elements, are disposed on the substrate 20 and electrically connected to the circuitry of the substrate 20, as shown in FIG. 2A'.

The package encapsulant 21 has a first side 21*a* (i.e., an upper side in the figure) and a second side 21*b* (i.e., a lower side in the figure) opposing the first side 21*a*, and the second side 21*b* is combined with the substrate 20 and encapsulates the electronic elements 23, as shown in FIG. 2A'. In an embodiment, the package encapsulant 21 may be made of any material such as encapsulating resin.

The antenna structure 22 is made of metal, and has a first extension layer 22*a*, a second extension layer 22*b*, and connection portions 22*c*. The first extension layer 22*a* is in contact with the package encapsulant 21. The second extension layer 22*b* is disposed on the substrate 20. The first extension layer 22*a* and the second extension layer 22*b* are spaced apart by the connection portions 22*c*. The connection portions 22*c* are electrically connected to the first extension layer 22*a* and the second extension layer 22*b*. In practice, the second extension layer 22*b* is disposed on a lower side of the electronic package structure 2 correspondingly (i.e., above the second side 21*b* of the package encapsulant 21).

In an embodiment, the first extension layer 22*a* is disposed on a surface of the first side 21*a* of the package encapsulant 21 and is exposed from the package encapsulant 21. The second extension layer 22*b* is exposed from a lower surface of the substrate 20. The first extension layer 22*a* and the second extension layer 22*b* are staggered on demands. In other words, the first extension layer 22*a* is not aligned with the second extension layer 22*b* in a vertical direction, as shown in FIG. 2A'. In another embodiment, the first extension layer 22*a* is aligned with the second extension layer 22*b* in the vertical direction. The connection portions 22*c* are metal vias and penetrate the package encapsulant 21 and the substrate 20. The first extension layer 22*a*, the second extension layer 22*b* and the connection portions 22*c* can be formed by a plating process or disposed by a laminate method. The first extension layer 22*a* and the second extension layer 22*b* can be in the shape of a straight line, waves, a curved line, etc.

The antenna structure 22 further has an acting portion 220, and the acting portion 220 and the first extension layer 22*a* are disposed at the same side and connected to the first extension layer 22*a*, such that the first extension layer 22*a* acts as an antenna body, as shown in FIG. 2A'. The acting portion 220 has a ground region 221 and a feeding portion 222 disposed in the ground region 221. In practice, the ground region 221 has a ground wire 221*a* to conduct the connection portions 22*c*, and the feeding portion 222 has a feeding line 222*a* to conduct the connection portions 22*c*. In another embodiment, no feeding region and no ground region are formed.

Figure 2B:
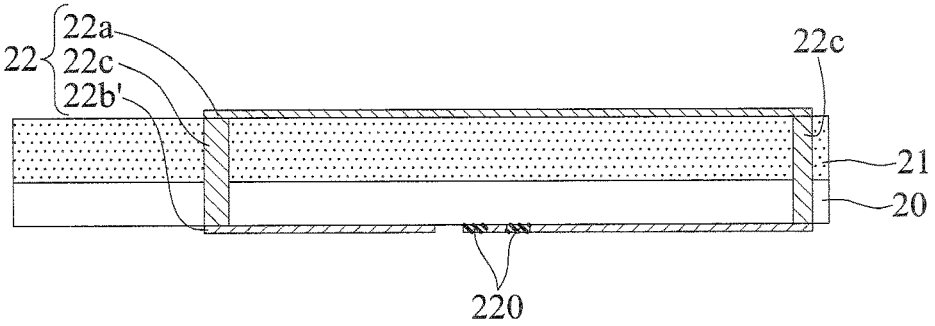

The acting portion 220 can be disposed at the same side as the second extension layer 22*b*', as shown in FIG. 2B, such that the second extension layer 22*b*' acts as the antenna body. The acting portion 220 of the second extension layer 22*b*' is connected as the disposition shown in FIG. 2A'.

Figure 2C:
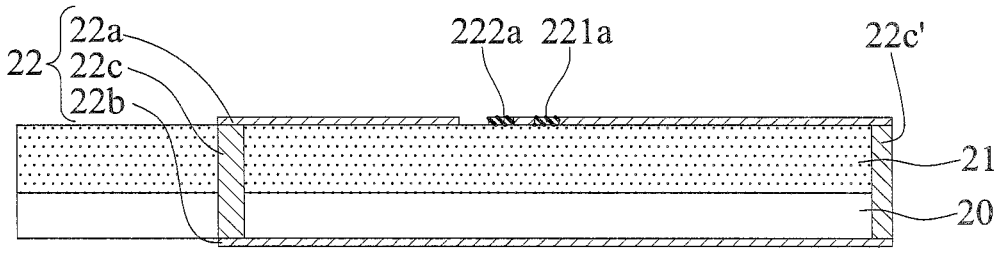
Figure 2D:
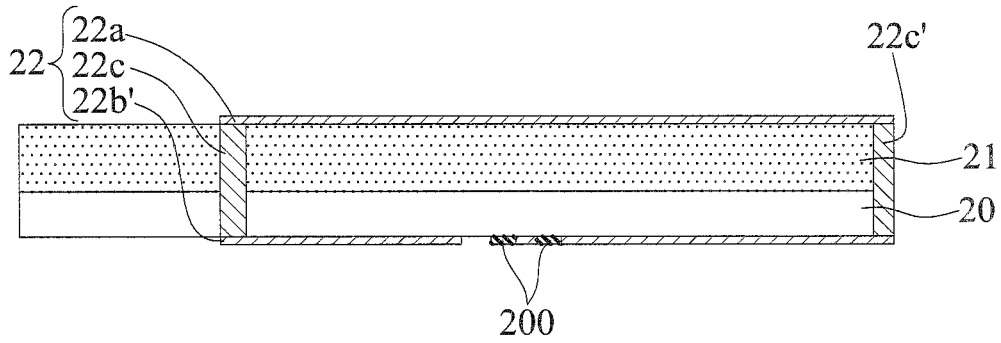
Figure 3A:
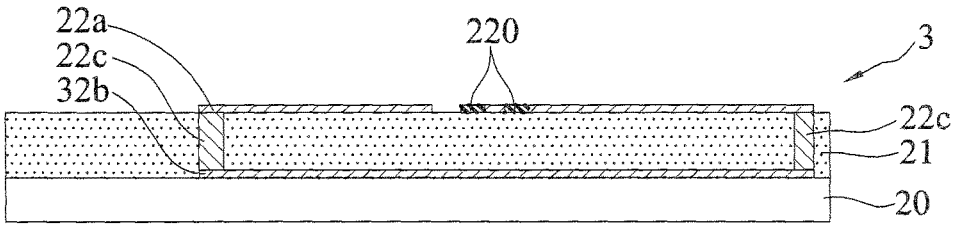
FIGS. 3A to 3D are cross-sectional views of an electronic package structure of a second embodiment according to the present invention.
Figure 3B:
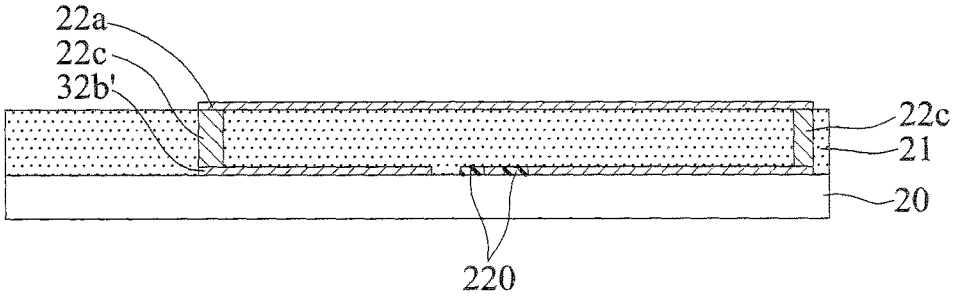
Figure 3C:
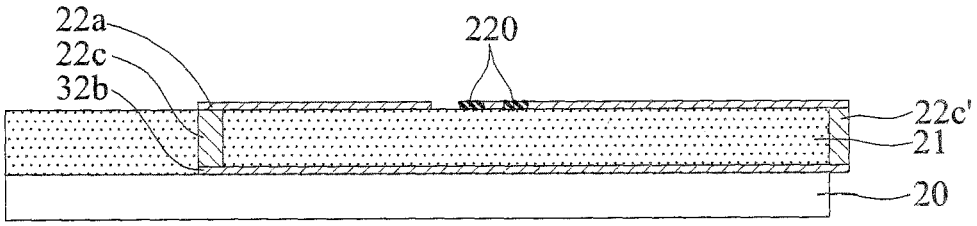
Figure 3D:
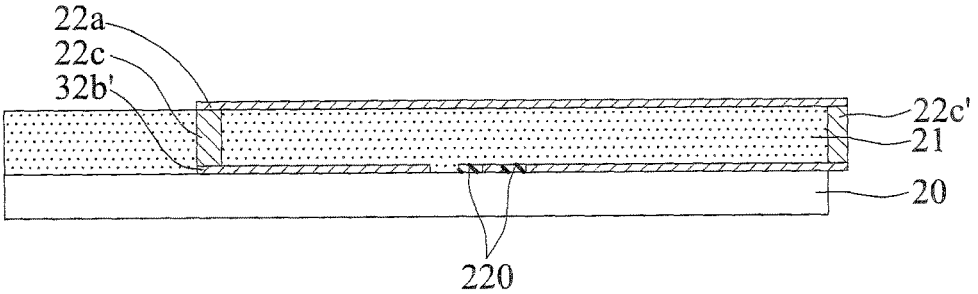
Figure 4A:
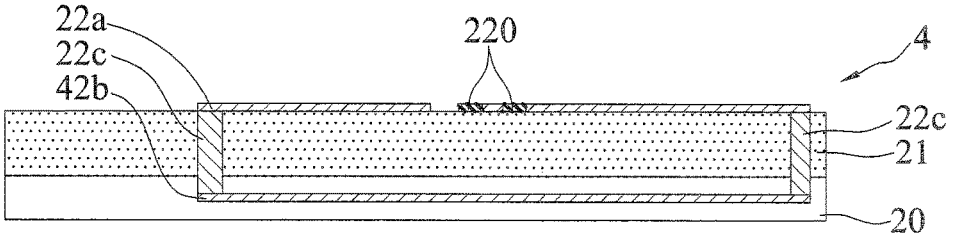
FIGS. 4A to 4D are cross-sectional views of an electronic package structure of a third embodiment according to the present invention.
Figure 4B:
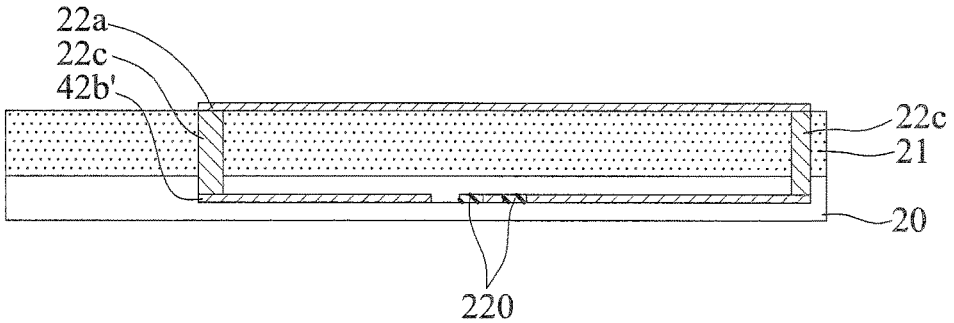
Figure 4C:
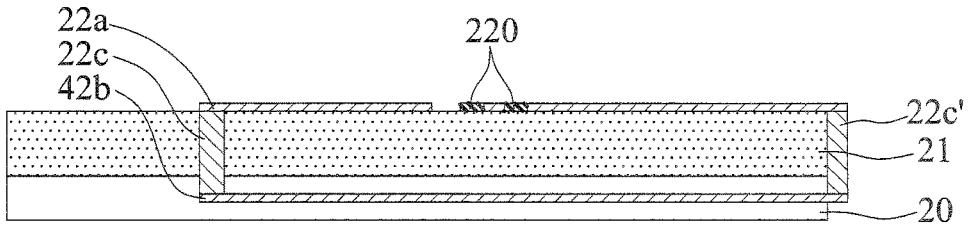
Figure 4D:
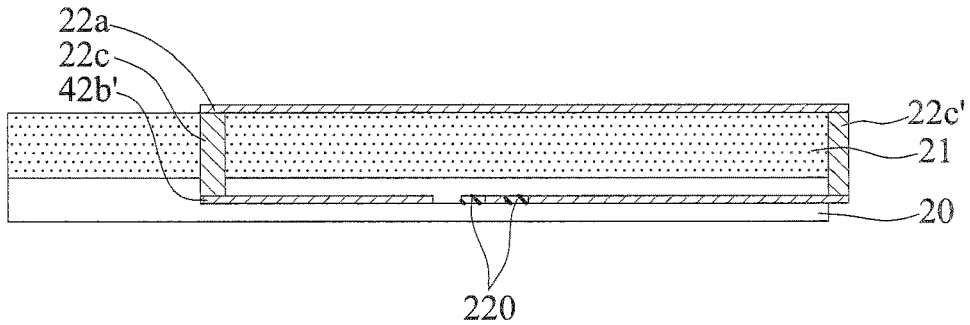
Figure 5A:
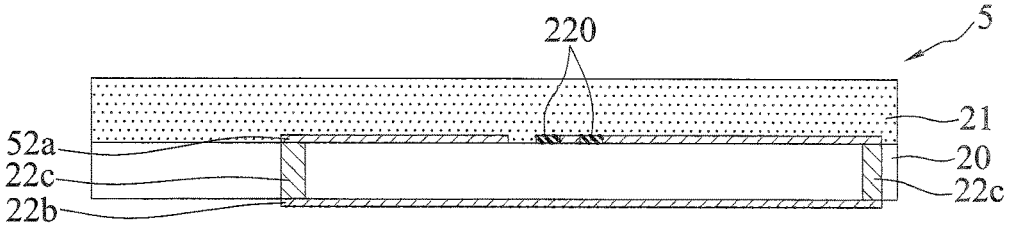
FIGS. 5A to 5D are cross-sectional views of an electronic package structure of a fourth embodiment according to the present invention.
Figure 5B:
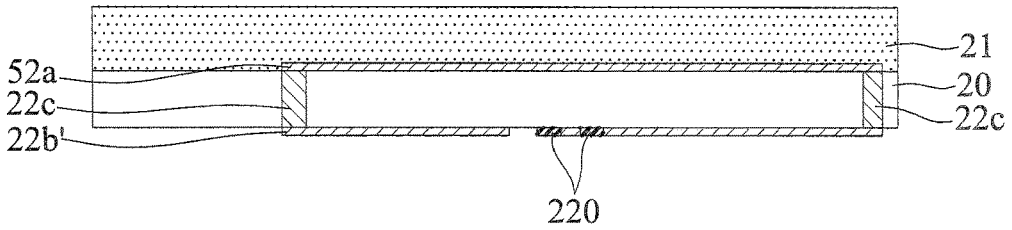
Figure 5C:
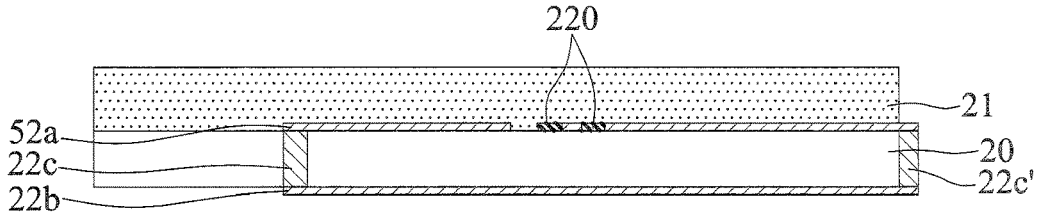
Figure 5D:
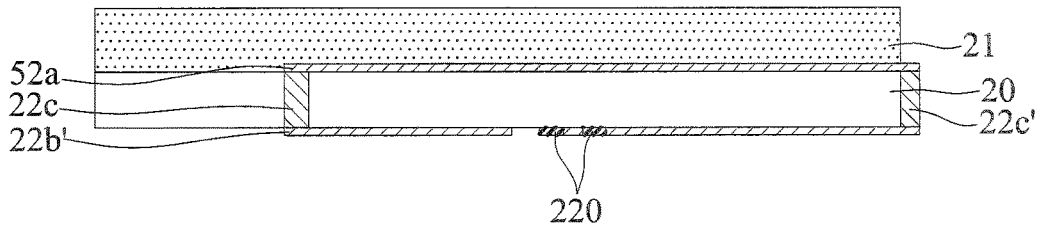
Figure 6A:
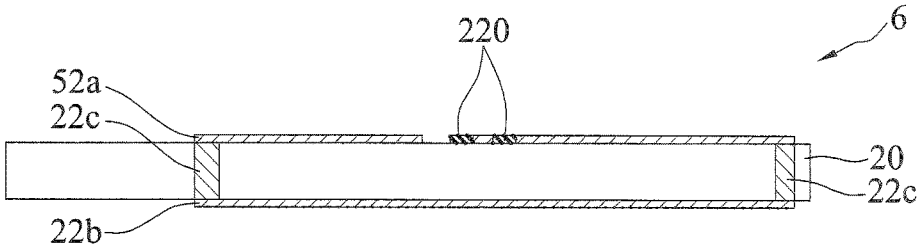
FIGS. 6A to 6D are cross-sectional views of an electronic package structure of a fifth embodiment according to the present invention.
Figure 6B:
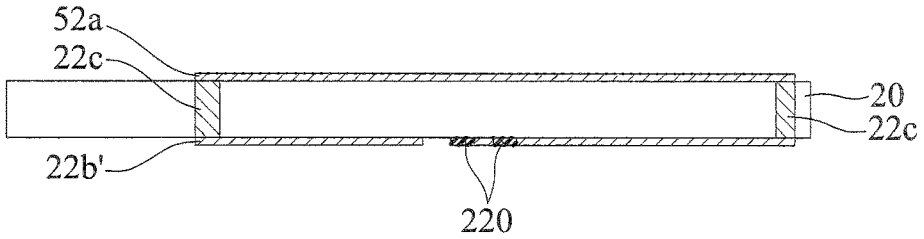
Figure 6C:
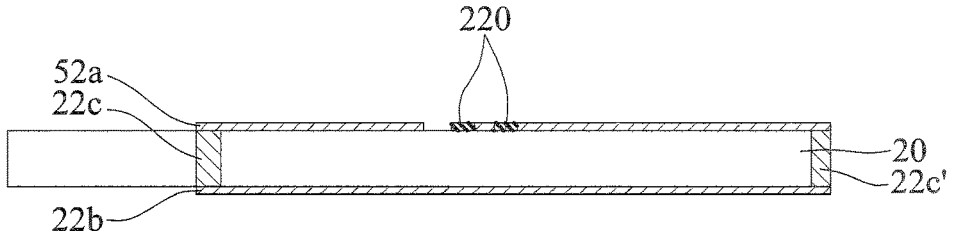
Figure 6D:
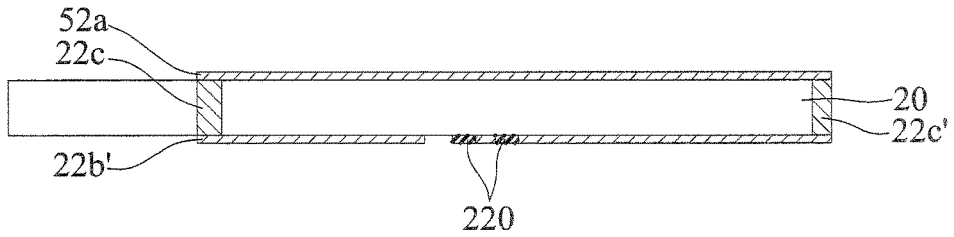
Figure 7A:
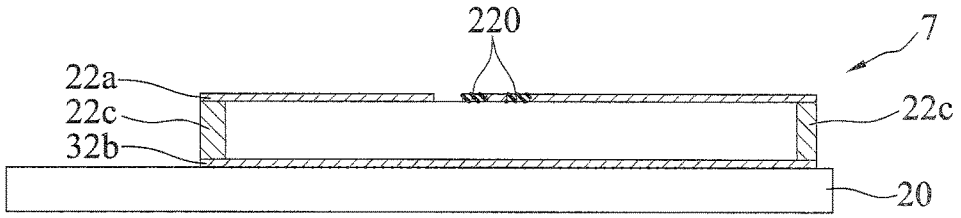
FIGS. 7A to 7D are cross-sectional views of an electronic package structure of a sixth embodiment according to the present invention.
Figure 7B:
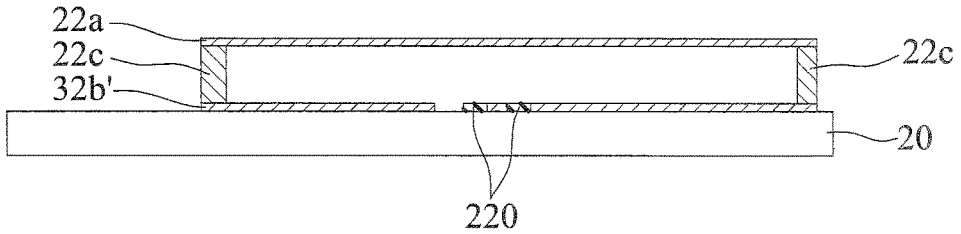
Figure 7C:
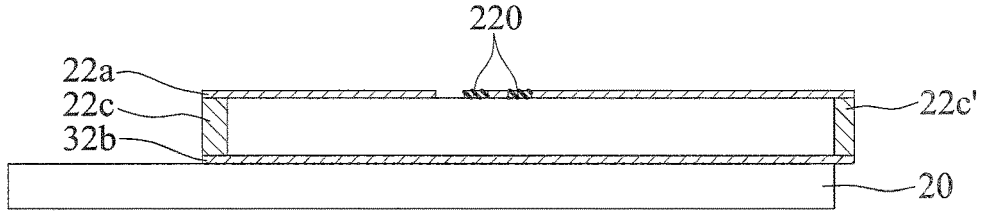
Figure 7D:
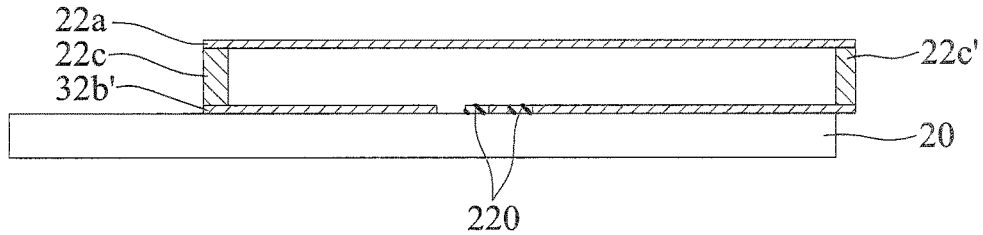

In the structure of FIGS. 2A and 2B, a portion of the connection portions 22*c*' can be disposed on a side surface of the package encapsulant 21 and a side surface of the substrate 20, as shown in FIGS. 2C and 2D. Alternatively, the entire connection portions 22*c*' can be disposed on the side surface of the package encapsulant and the side surface of the substrate (not shown).

In the electronic package structure 2 according to the present invention, a three-dimensional antenna structure 22 is formed on the package encapsulant 21, the first and second extension layers 22*a*, 22*b* and 22*b*' are disposed on the first side 21*a* and the second side 21*b* of the package encapsulant 21, respectively, and the connection portions 22*c* and 22*c*' are disposed on the package encapsulant 21 and the substrate 20, such that a disposing area of the antenna structure 22 corresponds to an area of the package encapsulant 21 during a manufacture process. Therefore, molds used in a package process can correspond to the size of the substrate 20, which facilitates the package process.

The first and second extension layers 22*a*, 22*b* and 22*b*' are formed on two opposing sides of the package encapsulant 21 (i.e., the first side 21*a* and the second side 21*b*) and form a three-dimensional antenna. The antenna structure 22 is thus disposed in an area where the substrate 20 forms the package encapsulant 21. Therefore, no disposing region is required to be formed on a surface of the substrate 20 additionally. Compared with the prior art, the substrate 20 according to the present invention is narrower, and so is the electronic package structure 2. The electronic package structure 2 can thus meet the miniaturization requirement.

The first extension layer 22*a* is stacked above the substrate 20, and a receiving space is thus formed between the first extension layer 22*a* and the substrate 20 for other electronic structures to be received therein.

FIGS. 3A, 3B, 3C and 3D are cross-sectional views of an electronic package structure 3 of a second embodiment according to the present invention. The second embodiment differs from the first embodiment in the disposing portions of the second extension layers 32*b* and 32*b*'. FIGS. 3A, 3B, 3C and 3D are improvements of FIGS. 2A, 2B, 2C and 2D, respectively.

As shown in FIGS. 3A-3D, the second extension layers 32*b* and 32*b*' are disposed on one side of the substrate 20 that combines with the package encapsulant 21 (i.e., the top side of the substrate 20), and the second extension layers 32*b* and 32*b*' are disposed in the package encapsulant 21. Since the second extension layer 32*b* is disposed on the top side of the substrate 20, the connection portions 22*c* and 22*c*' are disposed on the package encapsulant 21 only, without extending to and contacting with the substrate 20.

FIGS. 4A, 4B, 4C and 4D are cross-sectional views of an electronic package structure 4 of a third embodiment according to the present invention. The third embodiment differs from the first embodiment in the disposing positions of the second extension layers 42*b* and 42*b*'. FIGS. 4A, 4B, 4C and 4D are improvements of FIGS. 2A, 2B, 2C and 2D, respectively.

As shown in FIGS. 4A-4D, the second extension layers 42*b* and 42*b*' are embedded in the substrate 20, and the second extension layers 42*b* and 42*b*' are exposed from a surface of the substrate 20 (including upper and lower surfaces) or are not exposed from the surface of the substrate 20.

If the second extension layers 42*b* and 42*b*' are exposed from the upper surface of the substrate 20, the connection portions 22*c* and 22*c*' are disposed on the package encapsulant 21 only, without extending to or contacting with the substrate 20.

If the second extension layer 42*b* is not exposed from the substrate 20 or exposed from the lower surface of the substrate 20, the connection portions 22*c* and 22*c*' are disposed on the package encapsulant 21 and extend to and contact with the substrate 20.

FIGS. 5A, 5B, 5C and 5D are cross-sectional views of an electronic package structure 5 of a fourth embodiment according to the present invention. The fourth embodiment differs from the first embodiment in the disposing position of the first extension layer 52*a*. FIGS. 5A, 5B, 5C and 5D are improvements of FIGS. 2A, 2B, 2C and 2D, respectively.

As shown in FIGS. 5A-5D, the first extension layer 52*a* is disposed on the upper side of the substrate 20 and disposed in the package encapsulant 21, and the first and second extension layers 52*a*, 22*b* and 22*b*' are disposed on the upper and lower sides of the substrate 20, respectively. Therefore, the connection portions 22*c* and 22*c*' are disposed on the substrate 20 only.

According to the fourth embodiment, the second extension layers 22*b* and 22*b*' can be embedded in the substrate 20, or the first and second extension layers 52*a*, 22*b* and 22*b*' can all be embedded in the substrate 20.

Since the first extension layer 52*a* can be disposed in the package encapsulant 21, the first extension layer 22*a* in the first to third embodiments can also be embedded in the package encapsulant 21.

It is thus known from the first to fourth embodiments that the first extension layers 22*a* and 52*a* and the second extension layers 22*b*, 22*b*', 32*b*, 32*b*', 42*b* and 42*b*' are disposed at the position of the package encapsulant 21, and the first extension layers 22*a* and 52*a* and the second extension layers 22*b*, 22*b*', 32*b*, 32*b*', 42*b* and 42*b*' are spaced apart and are not in contact. Therefore, the antenna structure 22 is a three-dimensional antenna structure.

The first extension layers 22*a* and 52*a* are in contact with the package encapsulant 21. However, the first extension layers 22*a* and 52*a*, if embedded in the substrate 20 completely, cannot be in contact with the package encapsulant 21.

FIGS. 6A, 6B, 6C and 6D are cross-sectional views of an electronic package structure 6 of a fifth embodiment according to the present invention. The fifth embodiment differs from the fourth embodiment in that no package encapsulant 21 is formed in the fifth embodiment. FIGS. 6A, 6B, 6C and 6D are improvements of FIGS. 5A, 5B, 5C and 5D, respectively.

As shown in FIGS. 6A to 6D, a solder mask such as a solder resist is disposed on an outer surface of the substrate 20. The first and second extension layers 52*a*, 22*b* and 22*b*' are erected on one another and disposed on two opposing sides of the substrate 20 (e.g., the upper and lower sides of the substrate 20, or the upper and lower sides of the solder mask). The connection portions 22*c* are disposed in the substrate 20. Alternatively, the connection portions 22*c*' are disposed on the substrate 20.

The first and/or second extension layers 52*a*, 22*b* and 22*b*' can be embedded in the substrate 20.

FIGS. 7A, 7B, 7C and 7D are cross-sectional views of an electronic package structure 7 of a sixth embodiment according to the present invention. The sixth embodiment differs from the second embodiment in that no package encapsulant 21 is formed on the sixth embodiment. FIGS. 7A, 7B, 7C and 7D are improvements of FIGS. 3A, 3B, 3C and 3D.

As shown in FIGS. 7A to 7D, a solder mask such as a solder resist is disposed on an outer surface of the substrate 20, and the first and second extension layers 22*a*, 22*b* and 22*b*' are erected on one another and disposed on two opposing sides of the substrate 20 (e.g., the second extension layers 22*b* and 22*b*' are disposed on the upper side of the substrate 20, and the connection portions 22*c* and 22*c*' are disposed on the substrate 20 erectly).

The second extension layers 22*b* and 22*b*' can be embedded in the substrate 20.

The connection portions 22*c* and 22*c*' can be aligned with a side surface of the substrate 20 (not shown).

In an electronic package structure according to the present invention, a three-dimensional antenna structure replaces a planar antenna structure of the prior art. The antenna structure can be disposed within an area of the substrate where the package encapsulant is formed. Therefore, the electronic package structure has a reduced width and meets the miniaturization requirement.

The foregoing descriptions of the detailed embodiments are only illustrated to disclose the features and functions of the present invention and not restrictive of the scope of the present invention. It should be understood to those in the art that all modifications and variations according to the spirit and principle in the disclosure of the present invention should fall within the scope of the appended claims.

What is claimed is:

1. An electronic package structure, comprising:

a substrate having a top surface, a bottom surface opposed to the top surface, and a side surface adjacent to the top surface and the bottom surface, wherein the substrate includes circuitry;

a package encapsulant disposed on the top surface of the substrate; and an antenna structure corresponding to a disposing area of the package encapsulant and having a first extension layer, a second extension layer contacting the substrate, and a plurality of connection portions disposed between and electrically connected to the first extension layer and the second extension layer, wherein at least one of the connection portions penetrates the package encapsulant and the substrate, and at least another one of the connection portions is disposed on the side surface of the substrate and on a side surface of the package encapsulant.

2. The electronic package structure of claim 1, wherein the antenna structure further comprises an acting portion connected to the first extension layer or the second extension layer.

3. The electronic package structure of claim 2, wherein the second extension layer is exposed from the substrate.

4. The electronic package structure of claim 2, wherein the second extension layer is disposed in the package encapsulant.

5. The electronic package structure of claim 2, wherein the second extension layer is embedded in the substrate.

6. The electronic package structure of claim 2, wherein the first extension layer is exposed from the package encapsulant.

7. The electronic package structure of claim 2, wherein the first extension layer is disposed in the package encapsulant.

8. The electronic package structure of claim 2, wherein the first extension layer and the second extension layer are disposed on the top surface and the bottom surface of the substrate, respectively.

9. The electronic package structure of claim 2, wherein the first extension layer is embedded in the substrate.

10. The electronic package structure of claim 2, wherein the acting portion has a ground region and a feeding region.

11. The electronic package structure of claim 1, wherein the second extension layer is exposed from the substrate.

12. The electronic package structure of claim 11, wherein the antenna structure further includes another connection portion disposed on the package encapsulant and which extends and contacts the substrate.

13. The electronic package structure of claim 1, wherein the second extension layer is disposed in the package encapsulant.

14. The electronic package structure of claim 13, wherein the antenna structure further includes another connection portion disposed on the package encapsulant.

15. The electronic package structure of claim 1, wherein the second extension layer is embedded in the substrate.

16. The electronic package structure of claim 15, wherein the antenna structure further includes another connection portion disposed on the package encapsulant.

17. The electronic package structure of claim 15, wherein the antenna structure further includes another connection portion disposed on the package encapsulant and which extends and contacts the substrate.

18. The electronic package structure of claim 1, wherein the first extension layer is exposed from the package encapsulant.

19. The electronic package structure of claim 1, wherein the first extension layer is disposed in the package encapsulant.

20. The electronic package structure of claim 1, wherein the first extension layer is aligned or is not aligned with the second extension layer.

* * * * *